US010794399B2

(12) United States Patent
Wang et al.

(10) Patent No.: US 10,794,399 B2
(45) Date of Patent: Oct. 6, 2020

(54) CONVECTION FAN AND FAN BLADE STRUCTURE THEREOF

(71) Applicants: WOLONG ELECTRIC GROUP CO., LTD, Shaoxing, Zhejiang (CN); WOLONG ELECTRIC (JI NAN) MOTOR CO., LTD, Shandong (CN)

(72) Inventors: Cunling Wang, Shandong (CN); Xiaofei Liu, Shandong (CN); Liuxi Zhou, Shandong (CN)

(73) Assignees: WOLONG ELECTRIC GROUP CO., LTD, Shaoxing (CN); WOLONG ELECTRIC (JI NAN) MOTOR CO., LTD, Shaoxing (CN)

( * ) Notice: Subject to any disclaimer, the term of this patent is extended or adjusted under 35 U.S.C. 154(b) by 147 days.

(21) Appl. No.: 16/106,994

(22) Filed: Aug. 21, 2018

(65) Prior Publication Data

US 2019/0120252 A1 Apr. 25, 2019

(30) Foreign Application Priority Data

Oct. 19, 2017 (CN) ..... 2017 1 0979496

(51) Int. Cl.
*F04D 29/66* (2006.01)
*F04D 29/38* (2006.01)
(Continued)

(52) U.S. Cl.
CPC ..... *F04D 29/664* (2013.01); *F04D 29/281* (2013.01); *F04D 29/30* (2013.01);
(Continued)

(58) Field of Classification Search
CPC ..... F04D 29/281; F04D 29/30; F04D 29/388; F04D 29/668; F04D 25/08; F04D 29/26;
(Continued)

(56) References Cited

U.S. PATENT DOCUMENTS 70,286 A * 10/1867 Sturtevant ..... F04D 29/283
416/178
1,926,225 A * 9/1933 Birmann ..... F04D 29/285
416/90 R (Continued)

FOREIGN PATENT DOCUMENTS

CN 2420452 Y 2/2007
CN 1982726 A 6/2007

(Continued)

OTHER PUBLICATIONS

CN205895634U Machine Translation (Year: 2016).*

(Continued)

*Primary Examiner* — Moshe Wilensky
*Assistant Examiner* — Brian Christopher Delrue
(74) *Attorney, Agent, or Firm* — Fenwick & West LLP

(57) ABSTRACT

A fan blade structure of a convection fan includes a fan blade body. The fan blade body includes a central disk secured to the rotating shaft of the motor and multiple blades evenly distributed in a circumferential direction of the central disk. The fan blade body further includes an outer edge frame, the outer edge frame is connected to an outmost side of each of the blades in a radial direction of the central disk. The outer edge frame is connected to an outmost side of the blade in the radial direction of the central disk through the outer edge frame, which makes all the outmost sides of all the blades secured to the outer edge frame, thus the stability of the blade is strengthened, blade deformation in harsh environments is avoided, thereby the balance performance of the fan blade is improved, and the vibration or noise is reduced.

12 Claims, 2 Drawing Sheets

(51) Int. Cl.
*F04D 29/28* (2006.01)
*F04D 29/30* (2006.01)
*F04D 25/08* (2006.01)

(52) U.S. Cl.
CPC ..... *F04D 29/388* (2013.01); *F04D 29/668* (2013.01); *F04D 25/08* (2013.01); *F05D 2260/96* (2013.01)

(58) Field of Classification Search
CPC ... F04D 29/663; F04D 29/666; F05D 2260/96
See application file for complete search history.

(56) References Cited

U.S. PATENT DOCUMENTS 2,392,113 A * 1/1946 Anderson ..... F04D 29/283 416/184
2,458,041 A * 1/1949 Wessel ..... F04D 29/283 416/178
2,962,207 A * 11/1960 Mayne ..... F04D 29/283 416/187
4,120,257 A * 10/1978 Matucheski ..... F04D 29/388 29/889.7
D262,736 S * 1/1982 Wooden ..... D23/413
4,484,860 A * 11/1984 Brenholt ..... F04D 29/281 416/179
4,636,142 A * 1/1987 Baranski ..... F04D 29/388 416/210 R
5,165,855 A * 11/1992 Ricketts ..... F04D 29/283 416/178
5,240,189 A * 8/1993 Majkrzak ..... B02C 18/06 241/101.78
5,246,343 A * 9/1993 Windsor ..... F04D 29/325 416/210 R
6,368,062 B1 * 4/2002 Yagami ..... F04D 29/282 416/178
6,727,478 B2 * 4/2004 Rael ..... F24C 15/16 126/21 A
6,730,880 B2 * 5/2004 Smith ..... F24C 15/322 126/21 A
7,070,389 B2 * 7/2006 Kim ..... F04D 29/023 416/185
7,108,482 B2 * 9/2006 Chapman ..... F04D 29/30 415/206
7,114,844 B2 * 10/2006 Weetman ..... B01F 3/0478 366/328.3
7,121,799 B2 * 10/2006 Kim ..... F04D 29/023 416/186 R
7,513,107 B2 * 4/2009 Lehmann ..... F01N 3/32 60/280
7,669,637 B2 * 3/2010 Kubota ..... B22C 9/04 164/137
7,762,778 B2 * 7/2010 Purvines ..... B23P 15/006 416/186 A
8,882,467 B2 * 11/2014 Kwok ..... F04D 29/023 416/186 R
9,109,605 B2 * 8/2015 Chou ..... F04D 29/023
9,261,107 B2 * 2/2016 Kim ..... F04D 29/30
9,502,944 B2 * 11/2016 Neet ..... H02K 9/06
9,810,234 B2 * 11/2017 Bahren ..... F04D 29/283
9,890,797 B2 * 2/2018 Wilfley ..... F04D 29/622
2002/0028138 A1 * 3/2002 Lee ..... F04D 29/023 415/206
2003/0077174 A1 * 4/2003 Kim ..... F04D 29/283 416/186 R
2004/0253126 A1 * 12/2004 Cheng ..... F04D 29/023 417/423.1
2005/0071998 A1 * 4/2005 Rocky ..... B29C 66/54 29/889
2005/0260070 A1 * 11/2005 Hsu ..... F04D 25/0606 415/199.6
2008/0063542 A1 * 3/2008 Oguma ..... F04D 25/0613 417/354
2008/0156461 A1 * 7/2008 Otsuki ..... F04D 29/582 165/80.3
2009/0246026 A1 * 10/2009 Key ..... B23P 15/006 416/187
2010/0215486 A1 * 8/2010 Shirahama ..... F04D 29/283 415/204
2011/0318189 A1 * 12/2011 Teraoka ..... F04D 17/04 416/228
2012/0257965 A1 * 10/2012 Xia ..... F04D 25/0613 415/213.1
2013/0202441 A1 * 8/2013 Stagg ..... B29C 45/14336 416/204 R
2014/0133988 A1 * 5/2014 Son ..... F04D 29/282 416/189
2015/0064009 A1 * 3/2015 Huang ..... F04D 19/002 416/174
2015/0071782 A1 * 3/2015 Bahren ..... F04D 29/283 416/189
2015/0157818 A1 * 6/2015 Darby ..... A61M 16/0066 128/201.13
2015/0275922 A1 * 10/2015 Son ..... F04D 17/10 415/206
2016/0177966 A1 * 6/2016 Kim ..... F04D 17/16 416/234
2016/0290355 A1 * 10/2016 Lin ..... F04D 29/023
2018/0017084 A1 * 1/2018 Boutros-Mikhail ..... F04D 23/008

FOREIGN PATENT DOCUMENTS

CN 201372967 Y * 12/2009
CN 104265685 A 1/2015
CN 205225799 U 5/2016
CN 205895634 U * 1/2017
WO WO-2009065894 A1 * 5/2009 ..... F04D 29/285

OTHER PUBLICATIONS

CN201372967Y Machine Translation (Year: 2009).*
2016—Fan Rib (Year: 2016).*
China National Intellectual Property Administration, Office Action, CN Patent Application No. 201710979496.5, dated Dec. 26, 2018, nine pages.

* cited by examiner

CONVECTION FAN AND FAN BLADE STRUCTURE THEREOF

CROSS-REFERENCE TO RELATED APPLICATIONS

The present application claims the benefit of priority to Chinese patent application No. 201710979496.5 titled "CONVECTION FAN AND FAN BLADE STRUCTURE THEREOF," filed with the Chinese State Intellectual Property Office on Oct. 19, 2017, the entire disclosure of which is incorporated herein by reference.

FIELD

The present application relates to the technical field of fans, and more particularly to a convection fan and a fan blade structure of the convection fan.

BACKGROUND

It is well known that a convection fan generally includes a motor and multiple fan blades mounted to a rotating shaft of the motor. Each of the fan blades generally includes a fan blade body, which includes a central disk mounted to the rotating shaft of the motor and multiple blades evenly distributed in a circumferential direction of the central disk. Although the convection fan structure can realize basic functions of a convection fan, as for the situations that the working environment of the convection fan is harsh, such as a high temperature or a high rotating speed, blade deformation may be apt to occur due to its insufficient strength, thus causing the balance performance of the fan blade to be degraded and generating vibration and noise.

In conclusion, a technical issue to be addressed by the person skilled in the art presently is to solve the problem that the fan blade of the convection fan has a poor balance performance and the noise arises easily.

SUMMARY

The present application is to provide a convection fan and a fan blade structure of the convection fan, which solves the problem that the fan blade of the convection fan may be deformed easily and thus may result in an unbalance situation that arises vibration and noise easily.

A fan blade structure of a convection fan is provided in the present application, which includes a fan blade body. The fan blade body includes a central disk mounted to the rotating shaft of the motor and multiple blades evenly distributed in a circumferential direction of the central disk. The fan blade body further includes an outer edge frame, and the outer edge frame is connected to an outmost side of each blade in a radial direction of the central disk.

In one embodiment, the blade includes a first blade which is perpendicular to the axis of the central disk and a second blade which is perpendicular to the first blade.

In one embodiment, an outer edge of the outer edge frame is secured to an outmost side of the first blade.

In one embodiment, an outer edge of the outer edge frame is secured to an outmost side of the second blade.

In one embodiment, the outer edge frame comprises a first edge frame lying in the same plane with the first blade and a second edge frame having a preset angle with respect to the first edge frame.

In one embodiment, the second edge frame extends at a side of the fan blade structure which is provided with the second blade, and the second edge frame is secured to the second blade.

In one embodiment, the second edge frame extends at a side of the fan blade structure which is not provided with the second blade. A height of the second edge frame has a maximum value and a minimum value, in which the maximum value is 5 mm, and the minimum value is 1 mm.

In one embodiment, the outer edge frame is of a tubular structure, and the central line of the tubular structure coincides with the central line of the central disk, and the tubular structure is secured to the outmost side of the first blade, and the tubular structure is also secured to the outmost side of the second blade. A height of the second edge frame is equal to or less than 2 mm.

In one embodiment, the outer edge frame is of a cylindrical structure.

In one embodiment, the outer edge frame is of a tubular structure whose radius is gradually increased or decreased.

In one embodiment, the preset angle is greater than 90 degrees but smaller than 180 degrees.

In one embodiment, the outer edge frame and multiple blades are of an integral structure.

In one embodiment, the outer edge frame and multiple blades are of an integrally molded structure.

In one embodiment, the first blade is provided with a reinforcing rib.

In one embodiment, the reinforcing rib is formed by stamping.

Compared with the content in the background, the fan blade structure of the convection fan includes the fan blade body, and the fan blade body includes the central disk installed to the rotating shaft of the motor and the multiple blades evenly distributed in the circumferential direction of the central disk, and the fan blade body further includes the outer edge frame, and the outer edge frame is connected to the outmost side of the blade in the radial direction of the central disk. By the arrangement of the outer edge frame, the outer edge frame is connected to the outmost side of the blade in the radial direction of the central disk, which makes outmost sides of all the blades secured to the outer edge frame, thus the stability of the multiple blades is strengthened, and the blade deformation in harsh environments is avoided, thereby the balance performance of the fan blade is improved, and the vibration or noise is reduced.

A convection fan is further provided according to the present application. The convection fan includes a fan blade structure, and the fan blade structure is the fan blade structure of a convection fan according to any one of the solutions described hereinbefore. Since the fan blade structure of the convection fan has the above-described technical effects, the convection fan having the fan blade structure should also have corresponding technical effects, which will not be described herein.

Figure 1:
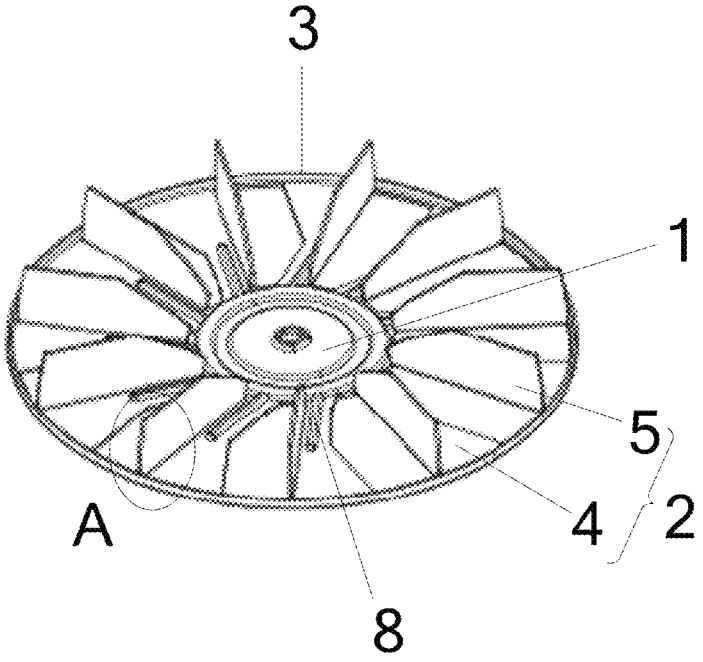
FIG. 1 is a schematic view showing an integral structure of a fan blade of a convection fan according to a first embodiment of the present application.
Figure 2:
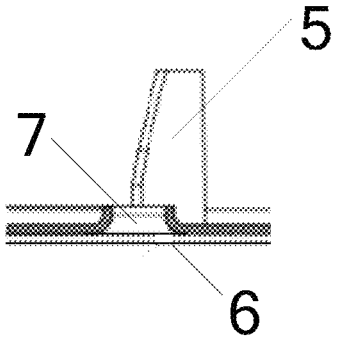
FIG. 2 is an enlarged sectional view showing A portion in FIG. 1 according to the first embodiment.

| | | | |
|---|---|---|---|
| 1 | central disk, | 2 | blade, |
| 3 | outer edge frame, | 4 | first blade, |
| 5 | second blade, | 6 | first edge frame, |
| 7 | second edge frame, | 8 | reinforcing rib. |

DETAILED DESCRIPTION

The present application is to provide a convection fan and a fan blade structure thereof, which solves the problem that the fan blade of the convection fan may be deformed easily and thus resulting in a poor balance performance and the problem that the vibration or noise arises easily.

For the people skilled in the art to better understand the technical solutions according to the present application, the present application will be further described in detail hereinafter in conjunction with the drawings and the specific embodiments.

Referring to FIG. 1 to FIG. 4, a fan blade structure of a convection fan according to an embodiment of the present application includes a central disk 1 installed to a rotating shaft of the motor and multiple blades 2 evenly distributed in a circumferential direction of the central disk 1, and the fan blade body further includes an outer edge frame 3, the outer edge frame 3 is connected to the outmost side of each blade 2 in a radial direction of the central disk 1.

In the fan blade structure of the convection fan, the outer edge frame 3 is connected to the outmost side of the blade in the radial direction of the central disk 1 through the arrangement of the outer edge frame 3, which makes all the outmost sides of all the blades 2 secured to the outer edge frame 3, thus the stability of the multiple blades 2 is strengthened, and the blade deformation in harsh environments is avoided, thereby the balance performance of the fan blade is improved, and the vibration or noise is reduced.

In some specific embodiments, a structure of the blade 2 specifically includes a first blade 4 which is perpendicular to an axis of the central disk 1 and a second blade 5 which is perpendicular to the first blade 4. It should be certainly understood that, the above description is only an example of the blade structure according to the embodiment of the present application, and may also be the blade structures of other convection fans that the people skilled in the art usually use. By the arrangement of the above structure, the fan blade structure of the convection fan is allowed to discharge the wind in the middle of the fan blade body to the circumferential direction of the fan blade body and realize circulation.

It should be noted that, the above-described fan blade of the fan is mainly used in the high temperature internal convection in an oven, and certainly the fan blade of the fan may also be applied to other electric appliances or equipment which has harsh working environment.

In order to make the second blades more stable and avoid deformation or vibration, the outer edge frame 3 is secured to an outmost side of the second blade 5. This can ensure the strength of the blade while minimizing the thickness of the second blade in design.

In some more specific embodiments, the structure of the outer edge frame 3 may specifically include a first edge frame 6 lying in the same plane with the first blade 4 and a second edge frame 7 having a preset angle B with respect to the first edge frame 6. The first edge frame 6 is connected to the first blade 4, and the second edge frame 7 may extend at a side of the fan blade structure which is provided with the second blade and be secured to the second blade 5. Alternatively, the second edge frame 7 may extend at a side of the fan blade structure which is not provided with the second blade, that is, the second edge frame 7 is not secured to the second blade 5. A height of the second edge frame 7 has a maximum value and a minimum value. The maximum value is 5 mm, and the minimum value is 1 mm in one embodiment, which may have little effect on the direction of the wind and the flowing rate of the wind.

It should be certainly understood that, the structure of the first edge frame and the second edge frame is only an example of the structure of the outer edge frame according to the embodiment of the present application, and the outer edge frame may also be a tubular structure. The central line of the tubular structure coincides with the central line of the central disk 1, and the tube wall is secured to the outmost side of the first blade 4, and the tube wall is also secured to the outmost side of the second blade 5. A height of the outer edge frame 3 may be equal to or less than 2 mm, which may have little effect on the direction of the wind and the flowing rate of the wind. Moreover, the tubular structure may be of a cylindrical structure, that is, the outer edge frame 3 is perpendicular with the central disk 1. Certainly, the outer edge frame 3 may also be of a tubular structure whose radius is gradually increased or decreased.

In order to avoid the outer edge frame 3 blocking the wind as much as possible, the preset angle B is generally chosen to be larger than 90 degrees but smaller than 180 degrees, and, in an actual design process, the preset angle B may be chosen according to the design requirement of the direction of the wind discharged by the fan body.

In a further embodiment, the outer edge frame 3 and the multiple blades 2 are of an integral structure. It should be certainly understood that, the integral structure is only an example according to the embodiment of the present application, and a firm connection structure by bolts or rivets may also be used between the outer edge frame 3 and the multiple blades 2, and the integral structure is employed according to the present application.

Figure 3:
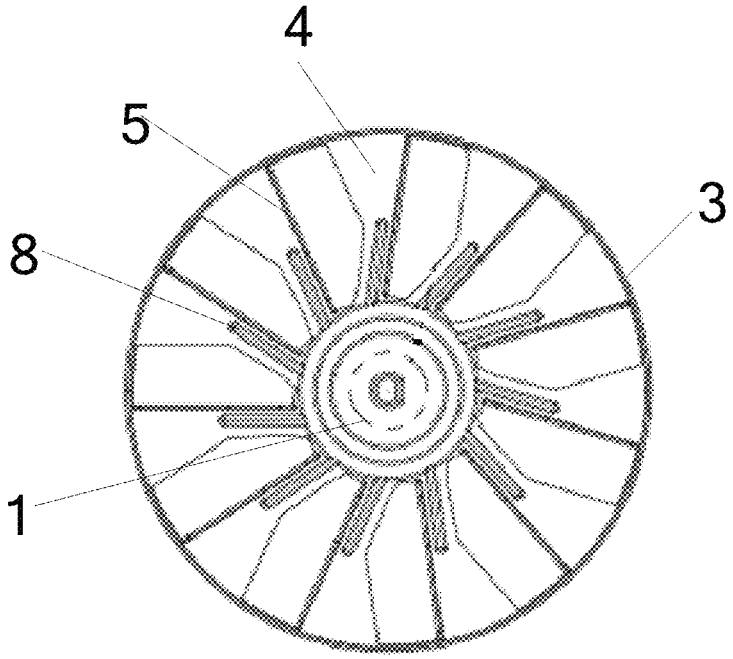
FIG. 3 is a schematic top view showing the structure of a fan blade of a convection fan according to the embodiment of the present application.
Figure 4:
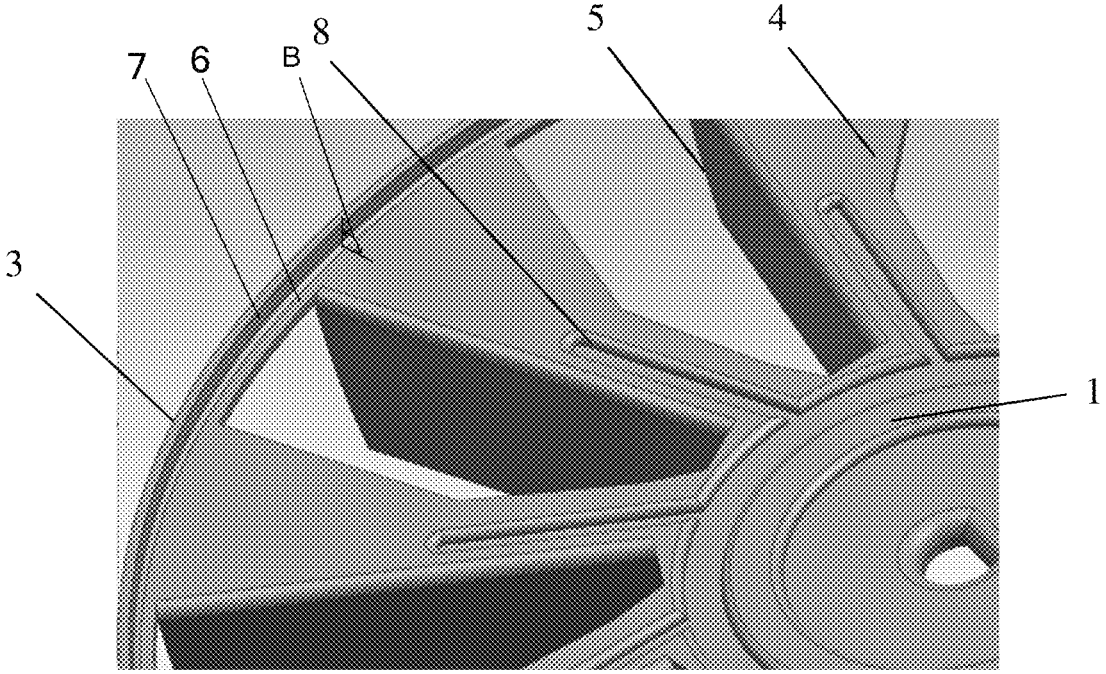
FIG. 4 is a schematic view showing an integral structure of a fan blade of a convection fan according to a second embodiment of the present application Reference numerals in the FIGS. 1 to 4.

Moreover, in the case that the outer edge frame 3 and the multiple blades 2 are of an integral structure, an integrally molded structure is employed since such structure can save materials while improving the production efficiency. For the people skilled in the art to better understand the technical solutions of the present application, an example is described hereinafter in conjunction with a preferable manufacturing process of the integrally molded structure. As shown in FIG. 3, corresponding positions of a disk plate are stamped and folded to form the second blade 5, and the first blade 4 remains on the disk plate, the outer edge of the disk plate is curled upward or downward to form the second edge frame. When the outer edge of the disk plate is curled upward, the second edge frame is secured to the second blade, and the first edge frame remains on the disk plate.

For ensuring the strength of the first blade 4, the first blade 4 is further provided with a reinforcing rib 8 in order to minimize the thickness of the first blade 4. The reinforcing rib 8 may be the reinforcing rib formed by stamping, and may also be the reinforcing rib formed by welding, which can be chosen during the actual manufacture according to the manufacturing capacity.

A convection fan is further provided according to the present application. The convection fan includes a fan blade structure, and the fan blade structure is the fan blade structure of the convection fan according to any one of the solutions described hereinbefore. Since the fan blade structure of a convection fan has the above-described technical effects, the convection fan having the fan blade structure should also have corresponding technical effects, which will not be described herein.

A convection fan and a fan blade thereof according to the present application is described in detail hereinbefore. It should be noted that, the above embodiments are described in a progressive manner, each of the embodiments is mainly focused on describing its differences from other embodiments, and references may be made among these embodiments with respect to the same or similar portions among these embodiments.

It should also be noted that, the terms "first", "second" and the like in the present application are used to distinguish an entity or operation from another entity or operation, and not necessarily require or imply the existence of any actual relationship or sequence between the entities and operations. Moreover, terms "include", "comprise" or any other variations are intended to cover non-exclusive "include", thus a process, a method, an object or a device including a series of factors not only include the listed factors, but also include other factors not explicitly listed, or also include inherent factors of the process, the method, the object or the device. Without more limitations, a factor defined by a sentence "include one . . . " does not exclude a case that there is another same factor in the process, the method, the object or the device including the described factor.

The principle and the embodiments of the present application are illustrated herein by specific examples. The above description of examples is only intended to help the understanding of the method and the spirit of the present application. It should be noted that, for the person skilled in the art, a few of modifications and improvements may be made to the present application without departing from the principle of the present application, and these modifications and improvements are also deemed to fall into the scope of the present application defined by the claims.

What is claimed is:

1. A fan blade structure of a convection fan, comprising:

a fan blade body, wherein the fan blade body comprises a central disk installed to a rotating shaft of a motor and a plurality of blades evenly distributed in a circumferential direction of the central disk, and the fan blade body further comprises an outer edge frame, and the outer edge frame is connected to an outmost side of each of the plurality of blades in a radial direction of the central disk, wherein each of the plurality of blades comprises a first blade which is perpendicular to an axis of the central disk wherein a surface of the first blade comprises a plane, and a second blade which is perpendicular to the first blade;

wherein the outer edge frame comprises a first edge frame lying in the same plane with the first blade, and a second edge frame; and wherein the second edge frame is formed by bending an outer edge of the first edge frame, to allow the second edge frame to have a preset angle with respect to the first edge frame, and the preset angle is greater than 90 degrees but smaller than 180 degrees.

2. The fan blade structure of the convection fan according to claim 1, wherein an outer edge of the outer edge frame is secured to an outmost side of the first blade.

3. The fan blade structure of the convection fan according to claim 1, wherein an outer edge of the outer edge frame is secured to an outmost side of the second blade.

4. The fan blade structure of the convection fan according to claim 1, wherein the second edge frame extends at a side of the fan blade structure which is provided with the second blade, and the second edge frame is secured to the second blade.

5. The fan blade structure of the convection fan according to claim 1, wherein the second edge frame extends at a side of the fan blade structure which is not provided with the second blade.

6. The fan blade structure of the convection fan according to claim 5, wherein a height of the second edge frame has a maximum value and a minimum value, in which the maximum value is 5 mm, and the minimum value is 1 mm.

7. The fan blade structure of the convection fan according to claim 6, wherein a height of the second edge frame is equal to or less than 2 mm.

8. The fan blade structure of the convection fan according to claim 1, wherein, the outer edge frame and the plurality of blades are of an integral structure.

9. The fan blade structure of the convection fan according to claim 8, wherein, the outer edge frame and the plurality of blades are of an integrally molded structure.

10. The fan blade structure of the convection fan according to claim 1, wherein, the first blade is provided with a reinforcing rib.

11. The fan blade structure of the convection fan according to claim 10, wherein, the reinforcing rib is formed by stamping.

12. A method for manufacturing the fan blade structure according to claim 1, comprising:

stamping a disk plate, folding a stamped portion to form the second blade, and the first blade and the first edge frame are kept on the disk plate; and bending an outer edge of the disk plate to form the second edge frame, and allow the second edge frame to have the preset angle with respect to the first edge frame.

* * * * *